US007127832B2

(12) United States Patent
Park et al.

(10) Patent No.: US 7,127,832 B2
(45) Date of Patent: Oct. 31, 2006

(54) CONTROL METHOD OF CLOTHES DRYER AND APPARATUS THEREOF

(75) Inventors: Dae-Yun Park, Gyeonggi-Do (KR); Kyung-Seop Hong, Incheon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/945,877

(22) Filed: Sep. 22, 2004

(65) Prior Publication Data

US 2005/0252028 A1 Nov. 17, 2005

(30) Foreign Application Priority Data

May 13, 2004 (KR) ..... 10-2004-0033962

(51) Int. Cl.
*F26B 21/06* (2006.01)
*F26B 3/00* (2006.01)

(52) U.S. Cl. ..... 34/562; 34/491; 34/527

(58) Field of Classification Search ..... 34/527, 34/528, 562, 486, 491, 550, 557
See application file for complete search history.

(56) References Cited

U.S. PATENT DOCUMENTS 4,385,452 A * 5/1983 Deschaaf et al. ..... 34/562
4,397,101 A * 8/1983 Rickard ..... 34/486
4,531,305 A * 7/1985 Nagayasu et al. ..... 34/445
4,713,894 A * 12/1987 Roth et al. ..... 34/486
6,047,486 A * 4/2000 Reck et al. ..... 34/491
6,449,876 B1 9/2002 Pursell

* cited by examiner

*Primary Examiner*—Kenneth Rinehart
(74) *Attorney, Agent, or Firm*—Greenblum & Bernstein, P.L.C.

(57) ABSTRACT

Disclosed are a control method of a clothes drier capable of preventing a laundry damage due to an over-drying and capable of decreasing a power dissipation, and an apparatus thereof. The control method of a clothes drier comprises the steps of: dividing a section that clothes dryness degree values varied as the clothes are dried are generated into a plurality of dryness degree detection sections; detecting the dryness degree values in the plurality of dryness degree detection sections according to a preset sampling rate or the number of samples; detecting a representative value of the detected dryness degree values; and drying the clothes with a preset heating value corresponding to the detected dryness degree representative value.

17 Claims, 6 Drawing Sheets

CONTROL METHOD OF CLOTHES DRYER AND APPARATUS THEREOF

BACKGROUND OF THE INVENTION

1. Field of the Invention

The present invention relates to a clothes dryer, and more particularly, to a control method of a clothes dryer and an apparatus thereof.

2. Description of the Conventional Art

Generally, a clothes dryer rotates clothes inside a drum by rotating the drum, and generates heat at a heater mounted therein. As a drying fan inside the clothes dryer is rotated, a low temperature-little moisture air passes through the heater thus to be converted into high temperature-little moisture air.

The clothes dryer heats clothes by introducing the high temperature-little moisture air into the drum. As the clothes are heated, vapor is generated and thereby the high temperature-little moisture air is converted into high temperature-much moisture air. The high temperature-much moisture air is condensed by an internal condenser thus to be converted into a low temperature-little moisture air with the moisture thereof removed. Then, the low temperature-little moisture air passes through the heater as the drying fan is rotated thereby to be converted into high temperature-little moisture air. That is, the clothes dryer dries clothes by repeatedly performing the process for heating clothes by introducing air into the drum. Also, the clothes dryer stops the operation of the heater when the clothes are completely dried, and drives only a motor thereby to cool the clothes so that a user can easily take out the clothes from the drum.

FIG. 1 is a view showing a sectional surface of a clothes dryer in accordance with the conventional art.

As shown, the clothes dryer comprises: a body 11; a drum 24 installed in the body 11 and accommodating clothes to be dried; a suction duct 14 formed at a rear surface of the drum 24 and supplying air into the drum 24; a suction fan 15 installed at the suction duct 14; and a motor 17 for driving the suction fan 15 and the drum 24. A door 21 for putting/taking laundry C in/out of the drum is installed at a front surface of the body 11, and an air passage 12 for introducing external air is formed at a rear surface of the body 11.

An air discharge passage 20 and an air discharge duct 18 for discharging air inside the drum 24 outwardly are formed at the front surface of the drum 24. The suction duct 14 for sucking air inside the body 11 and thereby supplying into the drum 24 is installed at a rear surface of the drum 24, and a suction passage 16 is formed at a lower portion of the suction duct 14. A heater 13 for heating air is installed at the suction passage of the suction duct 14. A plurality of lifts 23 for upwardly lifting the laundry C to be dried and dropping are formed in the drum 24.

Hereinafter, a front cover 22 positioned at the front surface of the drum 24 when the door 21 is closed will be explained with reference to FIG. 2.

FIG. 2 is a view showing a rear surface of the front cover of the clothes dryer.

As shown, an inlet port 25 for putting/taking the laundry C into/out of the drum is formed at the front surface of the drum 24, and the front cover 22 for covering the inlet port 25 is coupled thereto. A dryness degree sensor 19 for sensing a dryness degree of the laundry C inside the drum 24 is installed at a lower portion of the front cover 22.

Hereinafter, the dryness degree sensor 19 will be explained with reference to FIG. 3.

FIG. 3 is a view showing a dryness degree sensor of the clothes drier.

As shown, the dryness degree sensor 19 senses a dryness degree of the laundry C on the basis of a difference of current values varied according to a moisture contain degree of the laundry C at the time of contacting the laundry C. The dryness degree sensor 19 is composed of a pair of electrode sensors arranged in parallel with a certain interval. That is, as a moisture amount contained in the laundry is increased, a current value of the dryness degree sensor 19 is increased, and as a moisture amount contained in the laundry is decreased, a current value of the dryness degree sensor 19 is decreased. According to this, a dryness degree of the laundry can be sensed on the basis of the current value.

FIG. 4 is a view showing a dryness degree representative value calculated based on a signal of the dryness degree sensor of FIG. 2.

As shown, a dryness degree representative value is calculated on the basis of a signal value (dryness degree value) generated from the dryness degree sensor 19 as the laundry C to be dried is dried. On the basis of the calculated representative value, a heating value of the heater 13 and a driving of the drum 24 are controlled.

However, in a control method of the conventional clothes drier, a dryness degree representative value was calculated by equally applying the same sampling rate or the same number of samples even if a dryness graph showing a dryness degree of an initial period A that the laundry C contains much moisture and a dryness degree of a later period B that the laundry C relatively contains less moisture is non-linearly varied. Therefore, a dryness degree of the laundry C inside the drum 24 is not precisely reflected on the dryness degree representative value, thereby lowering a reliability of the dryness degree representative value.

Also, since a dryness degree of the laundry C is not precisely reflected on a dryness degree representative value, the laundry C is over-dried thus to have a damage or a deformation and a power consumption of the clothes drier is increased.

As aforementioned, in the conventional clothes drier, a dryness degree representative value is calculated by applying the same sampling rate or the same number of samples, and a heating value of the heater is controlled on the basis of the dryness degree representative value. According to this, the clothes are over-dried or an under-dry phenomenon that an operation for drying the clothes is stopped is frequently generated. Also, the heater is continuously operated even under a state that the clothes are completely dried, thereby consuming unnecessary much power.

Details of the conventional clothes drier are disclosed in U.S. Pat. No. 6,449,876 issued in Sep. 17, 2002.

SUMMARY OF THE INVENTION

Therefore, an object of the present invention is to provide a control method of a clothes drier capable of preventing a laundry damage due to an over-drying by precisely calculating a dryness degree representative value of clothes, and an apparatus thereof.

Another object of the present invention is to provide a control method of a clothes drier capable of effectively drying the clothes and decreasing a power dissipation, and an apparatus thereof.

To achieve these and other advantages and in accordance with the purpose of the present invention, as embodied and broadly described herein, there is provided a control method of a clothes drier comprising the steps of: dividing a section that clothes dryness degree values varied as the clothes are dried are generated into a plurality of dryness degree detection sections; detecting the dryness degree values in the plurality of dryness degree detection sections according to a preset sampling rate or the number of samples; detecting a representative value of the detected dryness degree values; and drying the clothes with a preset heating value corresponding to the detected dryness degree representative value. Herein, the preset sampling rate or the number of samples is differently set in each dryness degree detection section.

The control method of a clothes drier comprises the steps of: dividing a section that laundry dryness degree values varied as the laundry is dried are generated into a plurality of dryness degree detection sections; detecting the dryness degree values in the plurality of dryness degree detection sections according to a preset sampling rate or the number of samples; detecting a representative value of the detected dryness degree values; and drying the laundry with a preset heating value corresponding to the detected dryness degree representative value. Herein, the preset sampling rate is differently set in each dryness degree detection section.

The control method of a clothes drier comprises the steps of: dividing a section that laundry dryness degree values varied as the laundry is dried are generated into a plurality of dryness degree detection sections; detecting an average value of the dryness degree values according to the number of samples in the plurality of dryness degree detection sections; and drying the laundry with a preset heating value corresponding to the detected average value.

To achieve these and other advantages and in accordance with the purpose of the present invention, as embodied and broadly described herein, there is also provided an apparatus for controlling a clothes drier comprising: a heater driving unit for controlling a heater of a clothes drier; a motor for rotating a drum of the clothes drier; a dryness degree sensor contacting the clothes inside the drum, and generating dryness degree values corresponding to current values varied as the clothes are dried; and a control unit for dividing a section that the dryness degree values are generated into a plurality of dryness degree detection sections, detecting the dryness degree values in the plurality of dryness degree detection sections according to a preset sampling rate or the number of samples, detecting a representative value of the detected dryness degree values, and controlling the heater driving unit and the motor based on the detected dryness degree representative value.

The apparatus for controlling a clothes drier comprises: a heater; a sensor for generating dryness degree values corresponding to current values varied as the clothes are dried; and a control unit for dividing a section that the dryness degree values are generated into a plurality of sections, detecting the dryness degree values in the plurality of sections according to a preset sampling rate, and controlling the heater based on a representative value of the detected dryness degree values.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, with reference to FIGS. 5 to 10, will be explained a control method of a clothes drier and an apparatus thereof capable of preventing a laundry damage due to an over-drying and decreasing a power dissipation by comprising the steps of: dividing a section that clothes dryness degree values varied as the clothes are dried are generated into a plurality of dryness degree detection sections; detecting the dryness degree values in the plurality of dryness degree detection sections according to a preset sampling rate or the number of samples; detecting a representative value from the detected dryness degree values; and drying the laundry with a preset heating value corresponding to the detected representative value.

Figure 1:
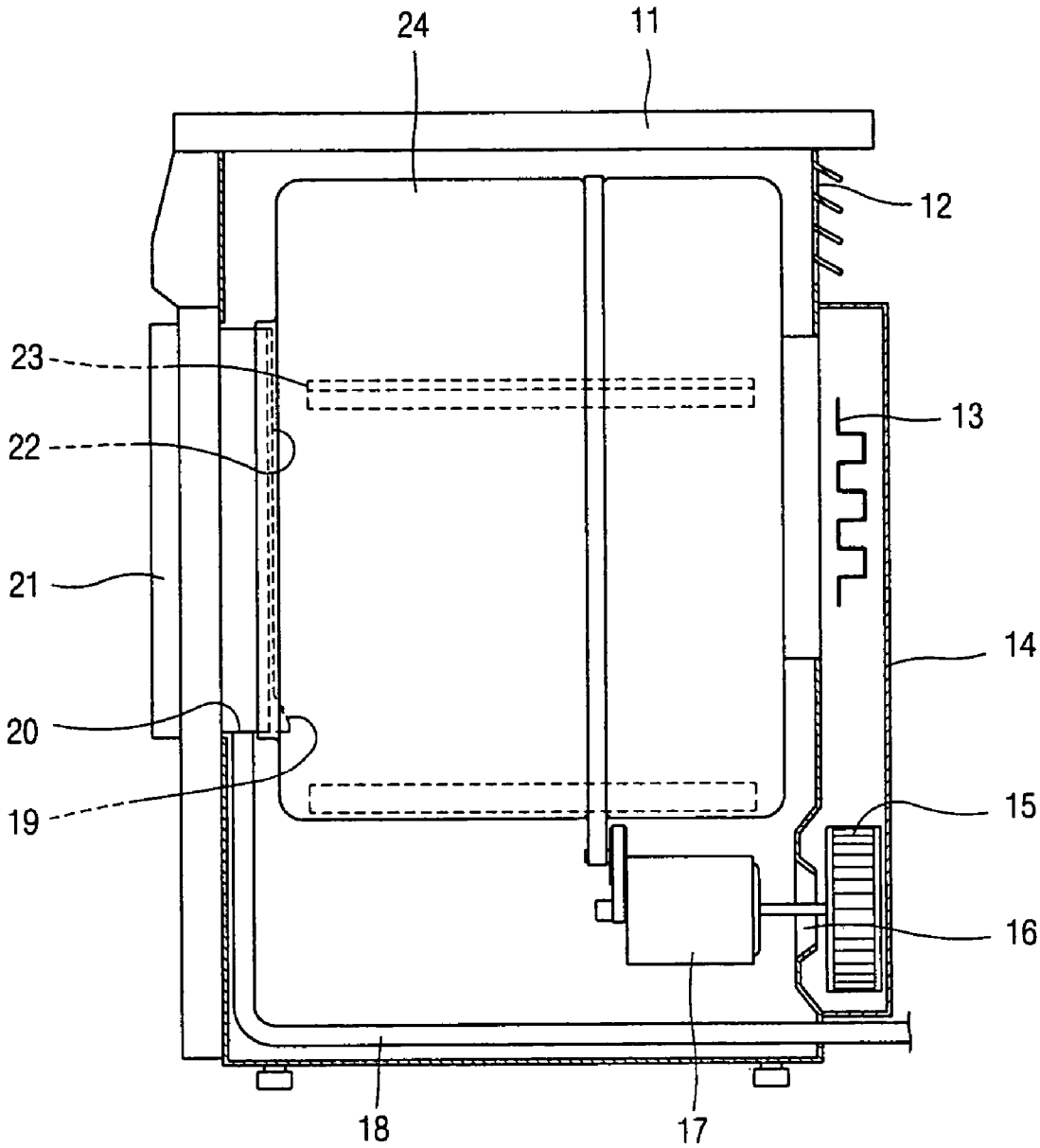
FIG. 1 CONVENTIONAL ART
FIG. 1 is a view showing a sectional surface of a clothes drier in accordance with the conventional art.
Figure 2:
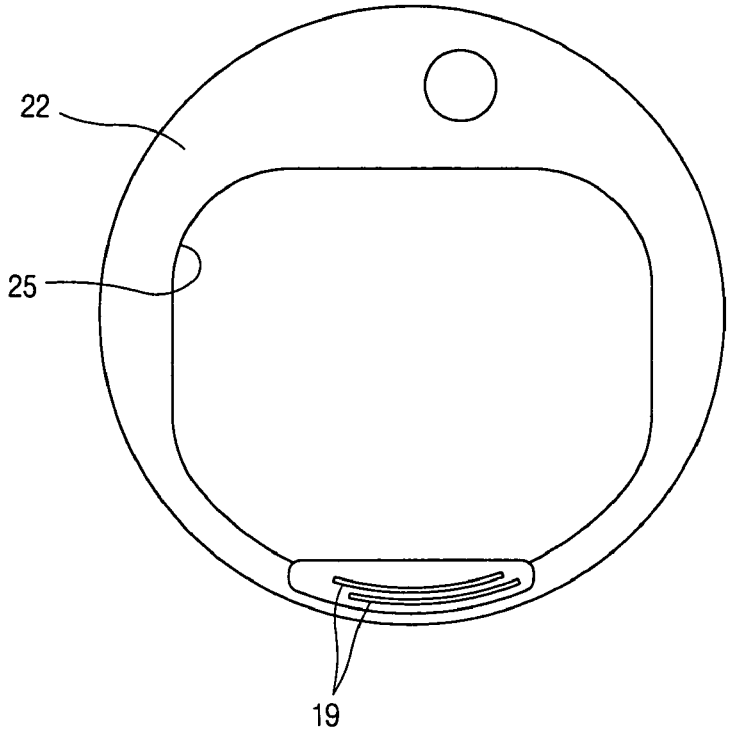
FIG. 2 CONVENTIONAL ART
FIG. 2 is a view sowing a rear surface of a front cover of the clothes drier.
Figure 3:
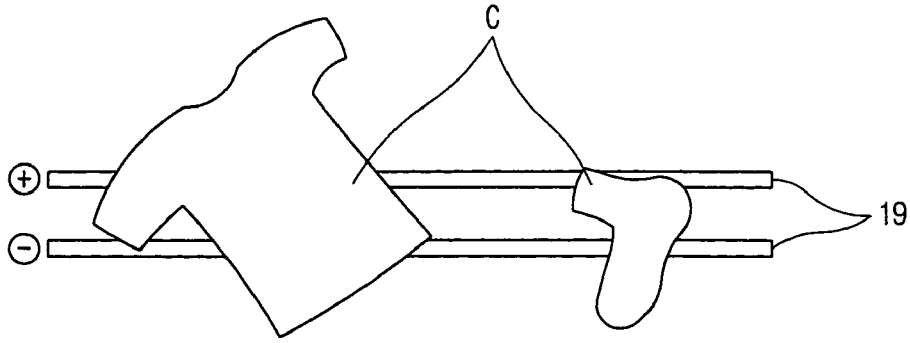
FIG. 3 CONVENTIONAL ART
FIG. 3 is a view showing a dryness degree sensor of the clothes drier.
Figure 4:
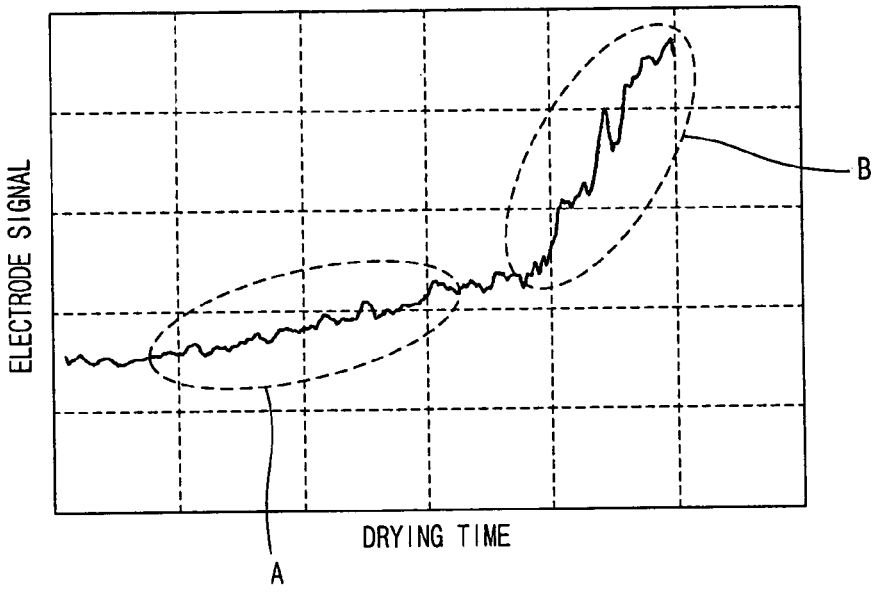
FIG. 4 CONVENTIONAL ART
FIG. 4 is a view showing a dryness degree representative value calculated based on a signal of the dryness degree sensor.
Figure 5:
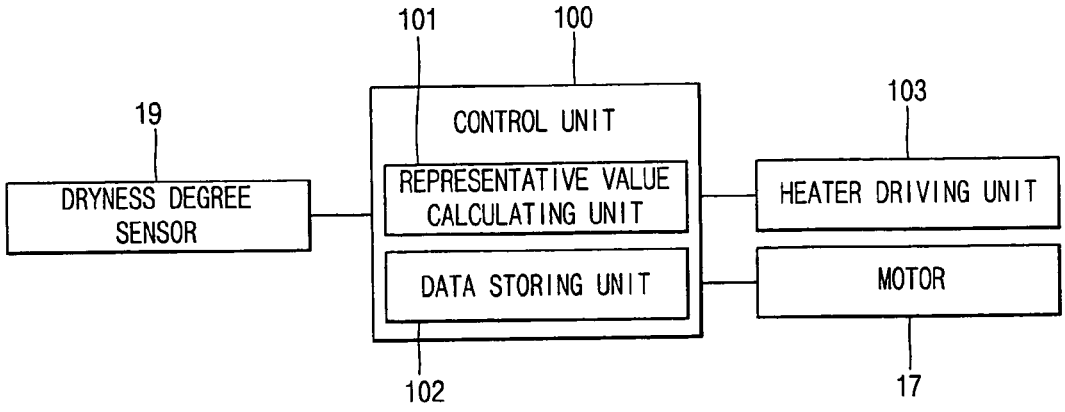
FIG. 5 is a block diagram showing a control unit of a clothes drier according to the present invention.

FIG. 5 is a block diagram showing a control unit of the clothes drier according to the present invention.

As shown, the control unit of the clothes drier according to the present invention comprises: a heater driving unit 103 for controlling a heating value of a heater; a motor 17 for rotating a drum 24; a dryness degree sensor 19 contacting the laundry (for example, the clothes) inside the drum, and generating dryness degree values corresponding to current values varied as the clothes are dried; and a control unit 100 for dividing a section that the dryness degree values varied as the laundry is dried are generated into a plurality of dryness degree detection sections, detecting the dryness degree values in the plurality of dryness degree detection sections according to a preset sampling rate or the number of samples, detecting a representative value of the detected dryness degree values, and controlling the heater driving unit 103 and the motor 17 based on the detected dryness degree representative value. The control unit 100 dries the laundry with a preset heating value corresponding to the detected representative value. The preset sampling rate or the number of samples is differently set in each dryness degree detection section in order to precisely detect the detected representative value.

The control unit 100 includes: a data storing unit 102 for storing a reference dryness degree value, a preset sampling rate or the number of samples according to each dryness degree detection section, and dryness degree values outputted from the dryness degree sensor 19; and a representative value calculating unit 101 for detecting dryness degree values outputted from the dryness degree sensor 19 according to the preset sampling rate or the number of samples, and calculating a representative value of the detected dryness degree values. The representative value calculating unit 101 calculates a representative value according to each dryness degree detection section, and the control unit 100 controls a heating value of the heater 13 by the heater driving unit 103 on the basis of the representative value according to each dryness degree detection section. The control unit 100 can be implemented as a microcomputer in which a control program is mounted.

Dryness degree values (signal values) outputted from the dryness degree sensor 19 and corresponding to current values varied as the laundry is dried will be explained with reference to FIG. 6 as follows.

Figure 6:
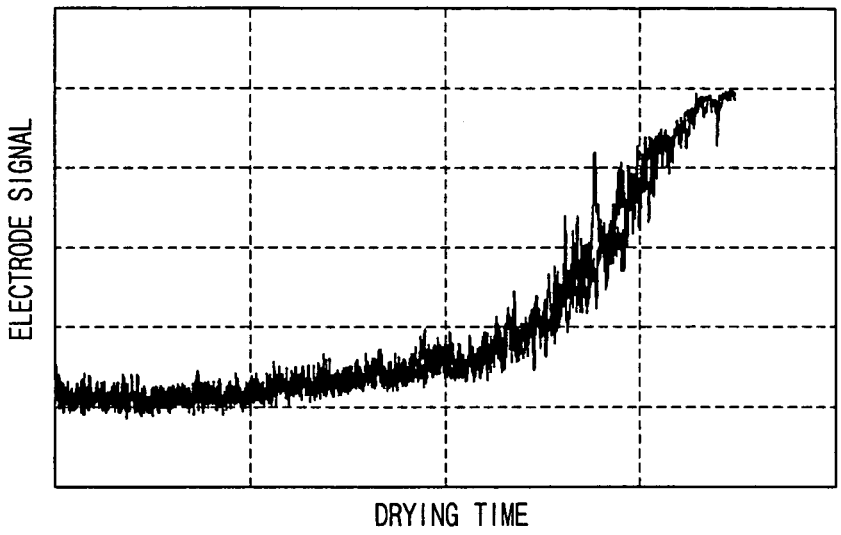
FIG. 6 is a view showing a signal outputted from a dryness degree sensor of the clothes drier.

FIG. 6 is a view showing signals outputted from the dryness degree sensor of the clothes drier.

As shown, signals outputted from the dryness degree sensor 19 for a total drying time of the laundry (for example, the cloth) are non-linear. That is, signals generated from the dryness degree sensor 19 are gradually increased until the earlier and middle drying time among the total drying time of the laundry (the clothes) (that is, the clothes are gradually dried). However, signals generated from the dryness degree sensor 19 are drastically increased at the later drying time (that is, the clothes are drastically dried).

In order to understand a correlativity of a dryness degree representative value calculated according to a sampling rate or the number of samples, the present inventor performed an experiment for detecting a representative value of dryness degree values outputted from the dryness degree sensor 19 by inputting the laundry into two equal cloth driers under a state that a kind and a moisture contain amount of the laundry are the same, and then by applying different sampling rates or the number of samples. Herein, the sampling rate and the number of samples have the same meaning. For example, if dryness degree values outputted form the dryness degree sensor 19 are collected under a state that the sampling rate is set to be one per a second, raw data for calculating a dryness degree representative value for a sampling time, 60 seconds, is 60. On the contrary, if dryness degree values outputted form the dryness degree sensor 19 are collected under a state that the number of samples is set to be 60, a sampling rate for collecting 60 raw data for the sampling time, 60 seconds is one per a second. Therefore, the sampling rate and the number of samples have the same meaning. The dryness degree representative value denotes an average value of collected dryness degree values, and the average value denotes a moving average value that moves as the laundry is dried.

Hereinafter, a process for detecting a representative value of dryness degree values outputted from the dryness degree sensor 19 by inputting the laundry into two equal cloth driers and then by applying different sampling rates or the number of samples will be explained with reference to FIGS. 7 and 8.

Figure 7:
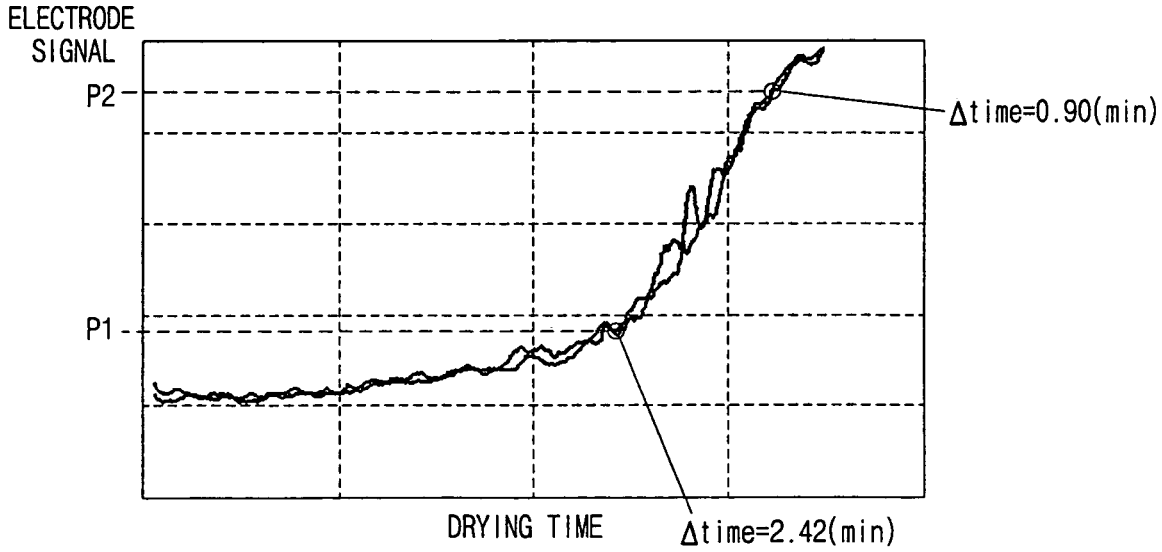
FIG. 7 is a view of an experiment example 1 showing a dryness degree representative value calculated by increasing a sampling rate or by decreasing the number of samples.

FIG. 7 is a view of an experiment example 1 showing a dryness degree representative value calculated by increasing a sampling rate or by decreasing the number of samples.

As shown, a dryness degree value of the clothes when on/off of a first heater (not shown) and a second heater (not shown) is initially controlled reaches the comparison point 1 (P1) with a time difference of 2.42 minutes when compared with that of an ideal dryness degree value. Also, a dryness degree value of the clothes when a power applied to the first and second heaters is cut off reaches the comparison point 2 (P2) with a time difference of 0.90 minutes when compared with that of an ideal dryness degree value. The heater 13 is composed of the first heater and the second heater having different heating values.

Figure 8:
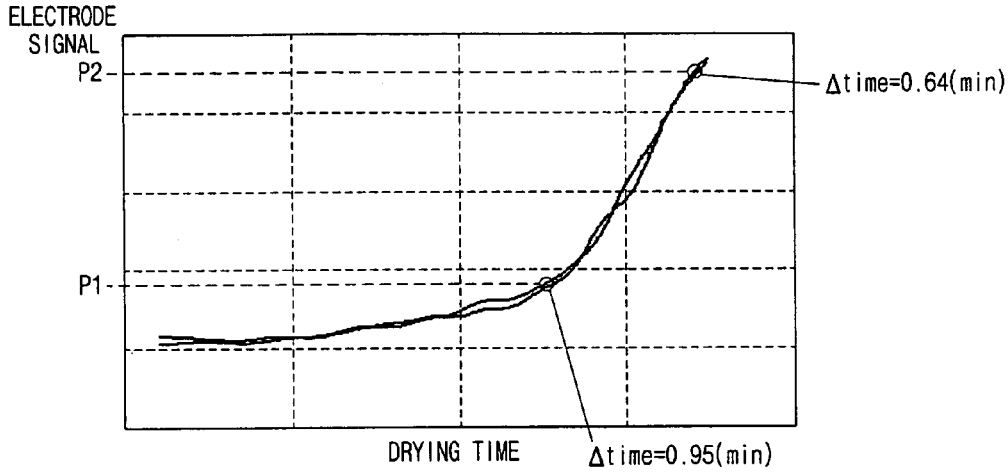
FIG. 8 is a view of an experiment example 2 showing a dryness degree representative value calculated by decreasing a sampling rate or by increasing the number of samples.

FIG. 8 is a view of an experiment example 2 showing a dryness degree representative value calculated by decreasing a sampling rate or by increasing the number of samples.

As shown, when a sampling rate decreased than that of the experiment example 1 or the number of samples increased than that of the experiment example 1 is applied to calculate a dryness degree representative value, a difference of the dryness degree representative value was entirely decreased than that of the experiment example 1. Especially, referring to a reaching time to the comparison point 1 (P1), the experiment example 2 shows a greatly decreased difference of 0.95 minutes when compared with the value of the experiment example 1, 2.42 minutes. The experiment example 2 shows a reliability that is relatively higher than that of the experiment example 1.

Referring to a reaching time to the comparison point 2 (P2), the experiment example 2 shows a difference of 0.64 minutes less than that of the experiment example 1, 0.90 minutes, thereby having a higher reliability. However, dryness degree values drastically varied as the sampling rate is decreased or the number of samples is increased are not fast reflected on the dryness degree representative value. That is, if dryness degree values drastically varied are not fast reflected on the dryness degree representative value at the reaching time to the comparison point 2 (P2) of the experiment example 2, the cloth are over-dried.

According to this, a section that dryness degree values varied as the clothes are dried are generated is divided into a plurality of dryness degree detection sections. Also, at the earlier drying time when the dryness degree values are gradually varied, the sampling rate is decreased or the number of samples is increased thereby to enhance a discrimination power of the dryness degree sensor 19. Also, at the later drying time when the dryness degree values are drastically varied, the sampling rate is increased or the number of samples is decreased thus to fast reflect the dryness degree values drastically varied on the dryness degree representative value, thereby enhancing a reliability of the dryness degree representative value. Herein, increasing the sampling rate indicates performing a sampling process more faster and more frequently.

Hereinafter, dryness degree values outputted from the dryness degree sensor 19, a dryness degree detection section, a reference dryness degree value, and a power applied to the heater will be explained with reference to FIG. 9.

Figure 9:
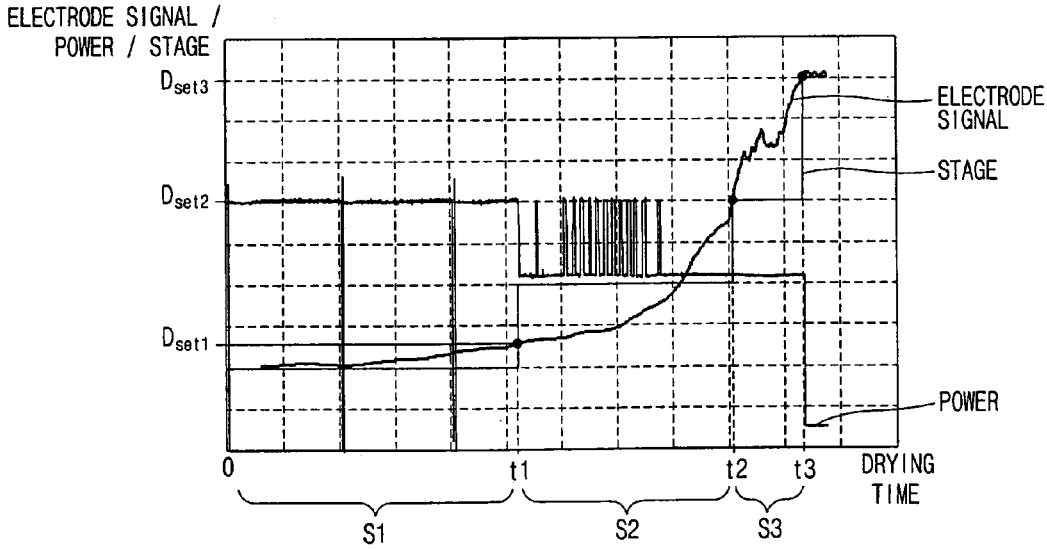
FIG. 9 is a view showing dryness degree values outputted from the dryness degree sensor, a dryness degree detection section, a reference dryness degree value, and a power applied to a heater.

FIG. 9 is a view showing dryness degree values outputted from the dryness degree sensor, a dryness degree detection section, a reference dryness degree value, and a power applied to the heater.

As shown, under an assumption that the first heater has a heating value greater than that of the second heater, a reference dryness degree value is set to be a first reference dryness degree value (Dset 1) corresponding to a time point (t1) that the first and second heaters are driven, a second reference dryness degree value (Dset 2) corresponding to a time point (t2) that the first is driven and the second heater is stopped, and a third reference dryness degree value (Dset 3) corresponding to a time point (t3) that the first and second heaters are stopped. Herein, the dryness degree detection section is divided into a first dryness degree detection section (S1) from a drying start time point to the reaching time (t1) of the first reference dryness degree value (Dset 3), a second dryness degree detection section (S2) from the reaching time (t1) of the first reference dryness degree value (Dset1) to the reaching time (t2) of the second reference dryness degree value (Dset2), and a third dryness degree detection section (S3) from the reaching time (t2) of the second reference dryness degree value (Dset2) to the reaching time (t3) of the third reference dryness degree value (Dset3). In order to precisely detect the dryness degree representative value and minutely dry the cloth, a plurality of the heaters can be installed, a plurality of the reference dryness degree values can be set, and a plurality of the dryness degree detection sections can be set. When a plurality of the heaters are installed, heating values of the plurality of heaters can be precisely controlled on the basis of the dryness degree representative value and the plurality of reference dryness degree values.

As the laundry to be dried is inputted into the drum 24 and the drying operation is started, the control unit 100 applies a power to the motor 17 and controls the heater driving unit 57 so that the heater 13 can be operated with a maximum heating value, thereby applying a power to the first and second heaters. As the motor 17 is rotated, air is sucked into a suction duct 14 by a suction fan 15 thus to upwardly flow. The upwardly flowing air is heated by the first and the second heaters thus to be introduced into the drum 24.

Hereinafter, a control method of the cloth drier according to the present invention will be explained with reference to FIGS. 9 and 10.

Figure 10:
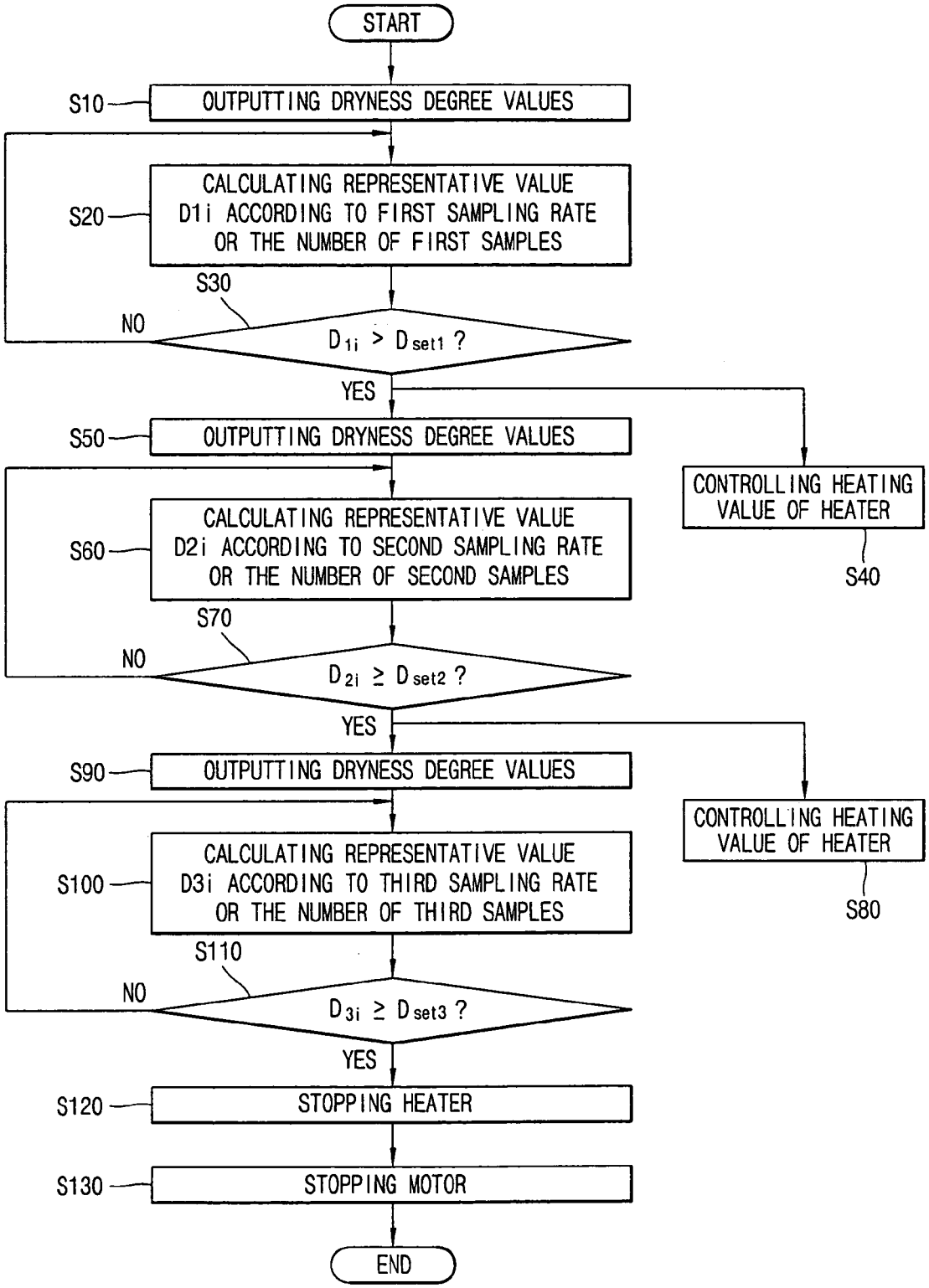
FIG. 10 is a flow chart showing a control method of the clothes drier according to the present invention.

FIG. 10 is a flow chart showing a control method of the clothes drier according to the present invention.

As shown, the control method of the clothes drier comprises the steps of: dividing a section that clothes dryness degree values varied as the clothes are dried are generated into a plurality of dryness degree detection sections; detecting the dryness degree values in the plurality of dryness degree detection sections according to a preset sampling rate or the number of samples; detecting a representative value of the detected dryness degree values; and drying the clothes with a preset heating value corresponding to the detected dryness degree representative value. Herein, the preset sampling rate or the number of samples is differently set in each dryness degree detection section.

The dryness degree sensor 19 contacts the laundry, and outputs dryness degree values generated according to a moisture amount contained in the laundry to the representative value calculating unit 101 (S10). The dryness degree value denotes a current value of the dryness degree sensor 19 varied according to a moisture amount of the laundry when the laundry is in contact with the dryness degree sensor 19. The current value is increased as a moisture amount contained in the laundry is increased, and is decreased as the moisture amount contained in the laundry is decreased. That is, the current value is proportional to a dryness degree of the laundry.

The representative value calculating unit 101 applies a preset first sampling rate or a first number of samples of the first dryness degree detection section S1 to dryness degree values outputted from the dryness degree sensor 19, thereby calculating a dryness degree representative value (D1*i*) of the first dryness degree detection section S1 (S20).

For example, when it is assumed that dryness degree values outputted from the dryness degree sensor 19 are collected by setting the number of samples according to each dryness degree detection section as 60, the first sampling rate of the first dryness degree detection section S1 is set to be two per second, the number of the first samples is 120 for a sampling time of 120 seconds, the second sampling rate of the second dryness degree detection section S2 is set to be 1.5 per second, the number of the second samples is 90 for a sampling time of 90 seconds, the third sampling rate of the third dryness degree detection section S3 is set to be one per second, and the number of the third samples is 60 for a sampling time of 60 seconds. Said dryness degree representative value of each dryness degree detection section (S1 to S3) can be calculated per a sampling rate of a corresponding dryness degree detection section. On the contrary, when it is assumed that dryness degree values outputted from the dryness degree sensor 19 are collected by setting a sampling rate according to each dryness degree detection section is one per second, the number of the first samples of the first dryness degree detection section S1 is 120 for a sampling time of 120 seconds, the number of the second samples of the second dryness degree detection section S2 is 90 for a sampling time of 90 seconds, and the number of the third samples of the third dryness degree detection section S3 is 60 for a sampling time of 60 seconds. The first dryness degree detection section S1 denotes the initial drying time of the clothes, the second dryness degree detection section S2 denotes the middle drying time of the clothes, and the third dryness degree detection section S3 denotes the later drying time of the clothes.

Therefore, it is preferable to decrease the sampling rate or to increase the number of samples at the earlier drying time or at the middle drying time, and it is preferable to increase the sampling rate or to decrease the number of samples at the later drying time. That is, it is preferable to increase the sampling rate or to decrease the number of samples as the clothes are dried.

The control unit 100 controls a heating value of the heater 13 by controlling the heater driving unit 57 (S40) when the dryness degree representative value D1*i* calculated by the representative value calculating unit 101 is the same or more than the first reference dryness degree value Dset1 of the first dryness degree detection section S1 (S30). For example, the control unit 100 controls the heater 13 with a preset heating value corresponding to the dryness degree representative value D1*i*. The heating value of the heater is decreased as the laundry is dried, and an over-drying of the laundry can be prevented by precisely detecting the dryness degree representative value, thereby reducing a power dissipation of the heater 13.

The control unit 100 continuously detects dryness degree values outputted from the dryness degree sensor 19 (S50) when the dryness degree representative value D1*i* calculated by the representative value calculating unit 101 is the same or more than the first reference dryness degree value Dset1 of the first dryness degree detection section S1.

Then, the representative value calculating unit 101 applies the second sampling rate or the number of the second samples to dryness degree values outputted from the dryness degree sensor 19 under the control of the control unit 100, thereby calculating a dryness degree representative value D2*i* of the second dryness degree detection section S2 (S60).

The control unit 100 controls a heating value of the heater 13 by controlling the heater driving unit 57 (S80) when the calculated dryness degree representative value D2*i* is the same or more than the preset second reference dryness degree value Dset2 (S70). That is, the control unit 100 controls the heater 13 with a heating value corresponding to the dryness degree representative value D2*i*.

The control unit 100 continuously detects dryness degree values outputted from the dryness degree sensor 19 (S90) when the dryness degree representative value D1*i* calculated by the representative value calculating unit 101 is the same or more than the third reference dryness degree value Dset3 of the third dryness degree detection section S3.

Then, the representative value calculating unit 101 applies the third sampling rate or the number of the third samples to dryness degree values outputted from the dryness degree sensor 19 under the control of the control unit 100, thereby calculating a dryness degree representative value D3*i* of the third dryness degree detection section S3 (S100).

The control unit 100 cuts off a power applied to the heater 13 by controlling the heater driving unit 57 (S120) when the calculated dryness degree representative value D3*i* calculated is the same or more than the preset third reference dryness degree value Dset3 of the third dryness degree detection section S3 (S110). When the power applied to the heater 13 is cut off, the control unit 100 rotates the drum 24 for a certain time thus to cool the clothes, and cuts off a power applied to the motor 17 thereby to complete the drying process of the clothes (S130).

The present invention can be applied to a washing machine having a drying function for drying the laundry, and can be applied to an apparatus for drying various kinds of the clothes or the laundry.

As aforementioned, in the control method of the clothes drier according to the present invention and the apparatus thereof, a section that clothes dryness degree values varied as the clothes are dried are generated is divided into a plurality of dryness degree detection sections, the dryness degree values are detected in the plurality of dryness degree detection sections according to a preset sampling rate or the number of samples, a representative value is detected from the detected dryness degree values, and the clothes are dried with a preset heating value corresponding to the detected representative value. According to this, the clothes are prevented from being over-dried or under-dried.

Also, in the control method of the clothes drier according to the present invention and the apparatus thereof, a section that clothes dryness degree values varied as the clothes are dried are generated is divided into a plurality of dryness degree detection sections, the dryness degree values are detected in the plurality of dryness degree detection sections according to a preset sampling rate or the number of samples, a representative value is detected from the detected dryness degree values, and the clothes are dried with a preset heating value corresponding to the detected representative value. According to this, a power dissipation can be decreased.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A control method of a clothes drier comprising the steps of:

dividing a section, having clothes dryness degree values that vary as clothes are dried, into a plurality of dryness degree detection sections;

detecting the dryness degree values in the plurality of dryness degree detection sections according to a preset sampling rate or a preset number of samples;

detecting a representative value of the detected dryness degree values; and drying the clothes with a preset heating value corresponding to the detected dryness degree representative value, wherein the preset sampling rate or the number of samples is differently set in each dryness degree detection section.

2. The method of claim 1, wherein in the step of drying the clothes, the clothes are dried with a preset heating value by a heater, and the heating value of the heater is decreased as the clothes are dried.

3. The method of claim 1, wherein in the step of detecting the dryness degree values, the dryness degree values are detected by decreasing the preset sampling rate or by increasing the preset number of samples in at least one section of the plurality of dryness degree detection sections.

4. The method of claim 3, wherein said at least one section is a section having clothes dryness degree values that vary as the clothes are dried at an initial drying time or at a middle drying time.

5. The method of claim 1, wherein in the step of detecting the dryness degree values, the dryness degree values are detected by increasing the preset sampling rate or by decreasing the preset number of samples in at least one section of the plurality of dryness degree detection sections.

6. The method of claim 5, wherein said at least one section is a section having clothes dryness degree values that vary as the clothes are dried at a later drying time.

7. The method of claim 1, wherein the sampling rate is increased as the clothes are dried, and the number of samples is decreased as the clothes are dried.

8. A method for drying laundry comprising the steps of:

dividing a section, having laundry dryness degree values that vary as laundry is dried, into a plurality of dryness degree detection sections;

detecting the dryness degree values in the plurality of dryness degree detection sections according to a preset sampling rate;

detecting a representative value of the detected dryness degree values; and drying the laundry with a preset heating value corresponding to the detected dryness degree representative value, wherein the preset sampling rate is differently set in each dryness degree detection section.

9. A method for drying laundry comprising the steps of:

dividing a section, having laundry dryness degree values that vary as the laundry is dried, into a plurality of dryness degree detection sections;

detecting an average value of the dryness degree values according to a preset number of samples of the plurality of dryness degree detection sections; and drying the laundry with a preset heating value corresponding to the detected average value.

10. The method of claim 9, wherein the number of samples is differently set in each dryness degree detection section, and is decreased as the clothes are dried.

11. An apparatus for controlling a clothes drier comprising:

a heater driving unit that controls a heater of a clothes drier;

a motor that rotates a drum of the clothes drier;

a dryness degree sensor contacting the clothes inside the drum, and generating dryness degree values corresponding to current values that vary as the clothes are dried; and a control unit that divides a section in which the dryness degree values are generated into a plurality of dryness degree detection sections, detecting the dryness degree values in the plurality of dryness degree detection sections according to a preset sampling rate or a preset number of samples, detecting a representative value of the detected dryness degree values, and controlling the heater driving unit and the motor based on the detected representative value.

12. The apparatus of claim 11, wherein the heater driving unit controls a heating value of the heater according to a control signal of the control unit.

13. The apparatus of claim 11, wherein the control unit includes:

a data storing unit that stores a preset sampling rate or the number of samples according to the plurality of dryness degree detection sections, and dryness degree values outputted from the dryness degree sensor; and a representative value calculating unit that detects dryness degree values according to the preset sampling rate or the number of samples, and calculating a representative value of the detected dryness degree values.

14. The apparatus of claim 12, wherein the representative value calculating unit calculates a representative value according to each dryness degree detection section, and the control unit controls a heating value of the heater by the heater driving unit on the basis of the representative value according to each dryness degree detection section.

15. The apparatus of claim 11, wherein the control unit decreases the heating value of the heater as the clothes are dried.

16. An apparatus for controlling a clothes drier comprising:

a heater;

a sensor that generates dryness degree values corresponding to current values that vary as clothes are dried; and a control unit that divides a section in which the dryness degree values are generated into a plurality of sections, detecting the dryness degree values in the plurality of sections according to a preset sampling rate, and controlling the heater based on a representative value of the detected dryness degree values, wherein the preset samplinci rate is differently set in each dryness degree detection section, and is set to be increased as the clothes are dried.

17. The apparatus of claim 16, wherein the control unit controls a heating value of the heater based on the representative value according to each dryness degree detection section.

* * * * *

UNITED STATES PATENT AND TRADEMARK OFFICE

CERTIFICATE OF CORRECTION

PATENT NO. : 7,127,832 B2
APPLICATION NO. : 10/945877
DATED : October 31, 2006
INVENTOR(S) : Park et al.

It is certified that error appears in the above-identified patent and that said Letters Patent is hereby corrected as shown below:

At column 12, line 21 (claim 16, line 12) of the printed patent, "samplinci" should be --sampling--.

Signed and Sealed this

Fifteenth Day of April, 2008

JON W. DUDAS
*Director of the United States Patent and Trademark Office*